United States Patent [19]

Shimizu

[11] 4,284,445

[45] Aug. 18, 1981

[54] PRODUCTION QUANTITY ADJUSTING APPARATUS FOR CORRUGATORS

[75] Inventor: Tadayuki Shimizu, Kanagawa, Japan

[73] Assignee: Nihon Electronic Industry Co., Ltd., Odawara, Japan

[21] Appl. No.: 38,134

[22] Filed: May 11, 1979

[30] Foreign Application Priority Data

May 17, 1978 [JP] Japan ..... 53-57515

[51] Int. Cl.[3] ..... G05G 15/00; B31F 5/04

[52] U.S. Cl. ..... 156/64; 156/205; 156/361; 156/378; 156/470; 156/351

[58] Field of Search ..... 156/64, 361, 378, 470, 156/205, 351

[56] References Cited

U.S. PATENT DOCUMENTS

| | | | |
|---|---|---|---|
| 3,411,388 | 11/1968 | Rappaport | 156/64 X |
| 3,966,518 | 6/1976 | Ferara et al. | 156/64 |
| 3,970,489 | 7/1976 | Schmidt | 156/64 |
| 3,981,758 | 9/1976 | Thayer | 156/64 |
| 3,997,929 | 8/1976 | Evans | 156/64 |
| 4,174,237 | 11/1979 | Hemming et al. | 156/64 |

*Primary Examiner*—David A. Simmons

*Attorney, Agent, or Firm*—Cooper, Dunham, Clark, Griffin & Moran

[57] ABSTRACT

An apparatus for detecting the correct timing of lot changing in a corrugator. The sum of a finished extent, which is the product of a specified cut length and the number of cut pieces excluding rejected cut pieces, and the residual quantity of a single-faced or double-faced corrugated board on the production line is subtracted from a lot size or length which is the product of the specified cut length and a specified number of cut pieces, to obtain a residual lot length, and this computation is successively performed at predetermined time intervals. The amount of raw material board fed is successively subtracted from the residual lot length, so that when the difference is reduced to zero, it is an indication of the desired lot changing timing.

9 Claims, 2 Drawing Figures

PRODUCTION QUANTITY ADJUSTING APPARATUS FOR CORRUGATORS

BACKGROUND OF THE INVENTION

The present invention relates to a production quantity adjusting apparatus for corrugators of a type which produces corrugated board by facing a corrugated core board with a liner or liner-board on one or both sides thereof.

The corrugated board is manufactured by using raw material boards in roll form as raw materials, and the raw material boards include a raw core board having corrugations of the corrugated board and a liner applied to each side of the core board. In a corrugator, a portion which applies a liner to a core board to manufacture a single-faced corrugated board is called a single facer section and another portion which applies a liner to the single-faced corrugated board is called a double facer section. The single facer section and the double facer section are generally arranged in line, and in particular the length of the single facer section ranges from a minimum of 50 m to a maximum of over 100 m. As a result, if the timing of changing the formation of raw material boards is inaccurate, it is not unusual that a considerable quantity of the raw material boards will be wasted.

With a known corrugator of this type, a change in the formation of raw material boards or lot changing is accomplished manually by the operator or alternatively a mark made of a silver paper or the like is attached to each raw material board just prior to the lot changing and the materials are made to run in this condition so that the residual amount of the raw materials existing between the place of feeding the raw materials and the place of finished product is measured to ensure accurate lot changing. A disadvantage of the former is that it is difficult to ensure the desired accuracy. The latter method is also disadvantageous in that while there is no problem with respect to accuracy, the method is not fit for use with small lots, and moreover since the materials are run with attached marks, the sheet portions having the attached marks must be rejected, thus causing a loss of sheets each time the residual quantity is measured. Particularly, the production process of the corrugator involves the manufacture of a wide variety of products ranging from several thousands to several tens of thousands of types resulting in the use of raw material boards diversified in width, basis weight, paper quality, etc., and there has existed a need for an apparatus which accomplishes the desired changeover of raw material boards or lot changing without any waste, thus ensuring efficient production.

SUMMARY OF THE INVENTION

It is an object of this invention to provide a production quantity adjusting apparatus for corrugators which overcomes the deficiencies in the conventional lot procedure in a corrugator and ensures an optimum lot changing. In accordance with the invention, the sum of a finished extent, which is the product of a specified cut length and the number of cut pieces excluding rejected cut pieces, and the residual quantity of single-faced or double-faced corrugated board on the production line is subtracted from a lot length, which is the product of the specified cut length and a specified number of cut pieces, to obtain a residual lot length, and the operation is performed continuously at predetermined time intervals, so that the amount of raw material supplied is successively subtracted from the residual lot length until the difference is reduced to zero at which time the lot changing is performed.

It is another object of the invention to provide a production quantity adjusting apparatus for corrugators, whereby in view of the fact that the occurrence of such unexpected trouble as defective lamination always requires the corrugator by its nature to remove the defective part from the bridge, in such a case the residual quantity is rapidly measured and the correct residual running meter is given to the single facer section, thus correcting the value of the residual length.

Other objects, features and advantages of the invention will become readily apparent from the following description taken in conjunction with the accompanying drawings.

DESCRIPTION OF THE PREFERRED EMBODIMENT

Figure 1:
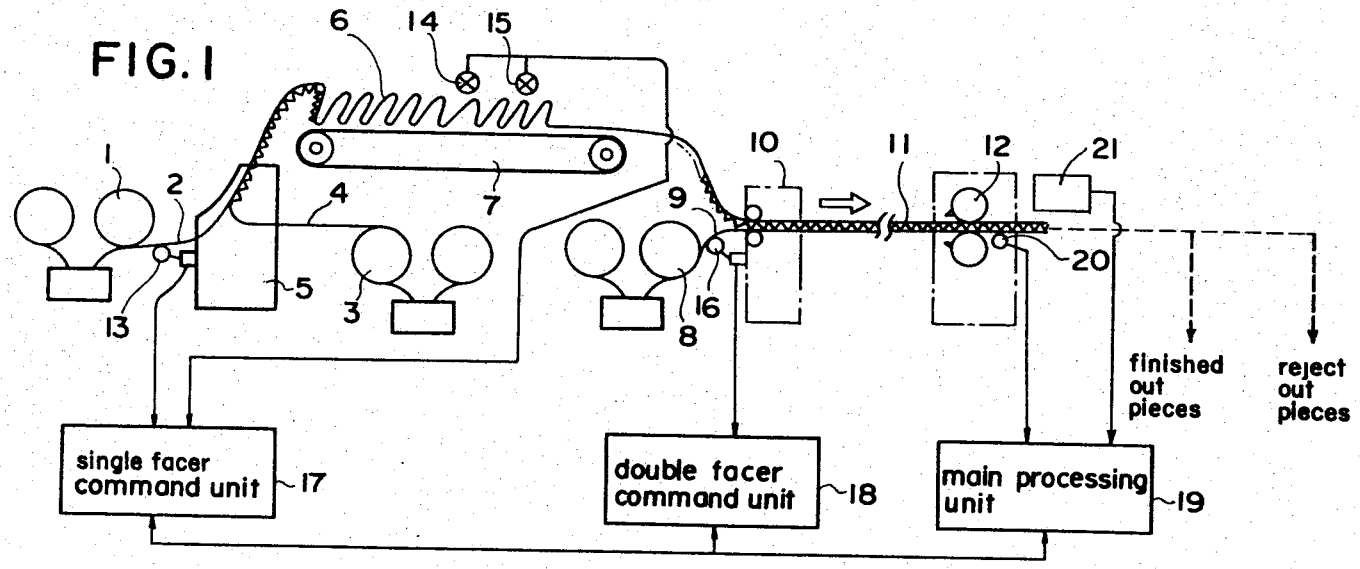
FIG. 1 is a schematic block diagram showing the basic construction of an embodiment of the present invention.

Referring to FIG. 1, there is illustrated the basic construction of an embodiment of the invention. The production process of double-faced corrugated board may be summarized as follows.

A liner 2 is fed from a mill roll 1 (raw corrugated board material) and a raw core board 4 is fed from a mill roll 3. The raw core board 4 is drawn into a pair of corrugated rolls (not shown) and is corrugated under the application of heat. Namely, the same effect takes place as if a cloth is creased with an iron. A first laminating unit 5 applies a paste to the top of the corrugations in the corrugated core board 4 and the core board 4 is stuck fast to the liner 2 thus producing a single-faced corrugated board 6. The single-faced corrugated board 6 is fed over a conveyor 7 on a bridge which is not shown in the drawings, and a liner 9 fed from a mill roll 8 is applied to the single-faced corrugated board 6 by a second laminating unit 10, thus producing a double-faced corrugated board 11. The double-faced corrugated board 11 is then cut to specified lengths by a rotary cutter 12. In the Figure, numeral 13 designates a pulse generator for measuring the running length of the liner 2 fed from the mill roll 1. Numerals 14 and 15 each designates a light emitter/receiver unit comprising for example a light emitting element and a light receiving element, so that when a reflecting point is reached i.e., when the top of a fold or loop of single-faced corrugated board reaches a point which is higher than a predetermined level, a signal is transmitted and received between the elements and in this way the tops of the loops of the corrugated single-faced corrugated board 6 on the conveyor 7 are detected. Numeral 16 designates a pulse generator for measuring the running length of the liner 9 fed from the mill roll 8. Numeral 17 designates a single facer command unit, 18 a double facer command unit, 19 a main processing unit, and 20 a pulse generator for supplying the number of pieces cut by the cutter 12 to the main processing unit 19.

The data of a specified number of cut pieces Cr and specified cut length Lr are preliminarily fed to the main processing unit 19 and a lot size or length Ll is obtained by the following computation $$Cr \times Lr = Ll \quad (1)$$

Each time the double-faced corrugated board 11 is cut to length by the rotary cutter 12, the main processing unit 19 computes the extent to which the desired lot is finished, herein termed a finished extent Lla from the following equation in accordance with a count value Ca of the number of pieces cut by the rotary cutter 12 provided by the output pulses of the pulse generator 20 and a count value Cano of the number of rejected pieces $$(Ca - Cano) \times Lr - Ca \times Lcl = Lla \quad (2)$$

where (Ca−Cano) is a count value representing the number of non-defective pieces which is obtained by subtracting the count value of the rejected pieces from the count value of the cut pieces, Lcl is the loss per piece of corrugated board due to the cutting of the double-faced corrugated board 11 by the rotary cutter 12, and (Ca×Lcl) is the loss for the total number of cut pieces. The loss Lcl is predetermined according to the type of the rotary cutter 12, the type of corrugated board, etc., and it is stored in the main processing unit 19 upon lot changing. Where the value of Lcl is extremely small or where the specified number of cut pieces Cr is small, the same may be ignored. As regards the count value Cano of rejected pieces, the number of rejected pieces may be obtained by the operator or by means of an accept-reject discrimination mechanism 21 which may be provided in the line, and this number may be supplied automatically or manually to the main processing unit 19.

The value of the lot length Ll obtained from the equation (1) is transferred to the command units 17 and 18, respectively. The command units 17 and 18 count down the value of the lot length Ll in response to the output of the pulse generators 13 and 16, respectively.

When a signal is applied to the command unit 17 from one or the other of the light emitter/receiver units 14 and 15, the command unit 17 applies a corrective computation request signal to the main processing unit 19. In response to the signal, the main processing unit 19 performs the necessary computations according to the equation (2) and the following equation $$Ll - Lla - Lrst - L'rst = Lrl \quad (3)$$

where Lrst is a preset residual quantity, which is the amount of the single-faced corrugated board 6 remaining between the mill roll 1 and the light emitter/-receiver unit 14 or 15, and L'rst is the distance between the light emitter/receiver unit 14 or 15 and the rotary cutter 12. These values are preliminarily measured and entered into the memory of the main processing unit.

Figure 2:
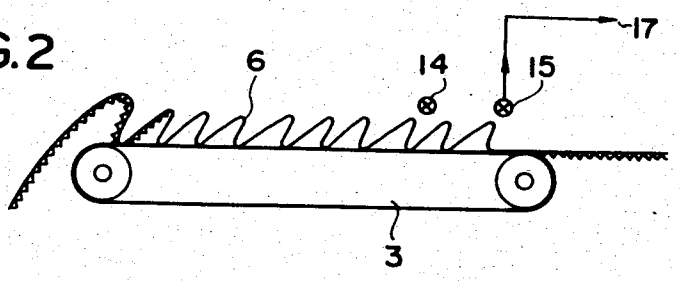
FIG. 2 is a schematic diagram showing the relative positional relation of light emitter/receiver units and a single-faced corrugated board for performing a computational operation to correct the residual length.

While, in principle, it is necessary to use only one of the light emitter/receiver units 14 and 15, in practice it may be necessary to use both of the units or a greater number of such units so as to control the residual quantity Lrst on the bridge to vary automatically within a certain range. However, where the residual quantity Lrst is increased or decreased manually by the operator, it is only necessary to use one or the other of the units 14 or 15. FIG. 2 shows a time instant at which a correction is effected. Where only the light emitter/receiver unit 15 is used, when the top each of the loops or folds in the single-faced corrugated board 6 approaches the light emitter/receiver unit 15, the computations of the equations (2) and (3) are performed automatically by processing unit 19. The resulting residual lot length Lrl is supplied to the single facer command unit 17 so that the newly computed residual lot Lrl is counted down in response to the output of the pulse generator 13 and the value of the residual length measure so calculated. In this way, each time a signal is applied from the light emitter/receiver unit 15, the main processing unit 19 performs the computations of the equations (2) and (3) so that the residual length value is replaced by the value of a residual lot length Lrl and the value is counted down. This process is performed repeatedly until the residual lot length or the residual length is reduced to zero, so that in response to the indication of the zero residual length the liner 2 and the core board 4 are respectively cut automatically or manually by the cutters (not shown) which are respectively disposed near the mill rolls 1 and 3.

As a result, by continuously computing and correcting the value of residual lot length Lrl, it is possible to prevent the occcurrence of loss due to any errors in the dimension of finished product, loss due to rejected product, etc., and thereby to improve the accuracy of residual length indication.

On the other hand, in the like manner as mentioned previously, the value applied to the double facer command unit 18 from the main processing unit 19 is counted down in response to the output pulses of the pulse generator 16 which are generated in proportion to the feed quantity of the liner 9, so that when the residual length is reduced to zero, the liner 9 is cut automatically or manually by a cutter (not shown) arranged in the vicinity of the mill roll 8.

In the above-mentioned embodiment, the main processing unit 19 applies the necessary data to the command unit 18 by performing the similar computations as the previously mentioned computations (1) to (3) for the single facer section and it computes a second residual lot length L'rl according to the following equation (3)', with Lrst being set to zero and L'rst representing the distance between the mill roll 8 and the rotary cutter 12

$$Ll - Lla - L'rst = L'rl \quad (3)'$$

In the event that any defectively laminated single-faced corrugated board of the liner 2 and the raw core board 4 is rejected on the bridge in the single facer section, the same processing takes place as in the previously mentioned case of removing the reject product, thus preventing any error.

It will thus be seen from the foregoing that the present invention completely eliminates the occurrence of loss due to lot changing.

Each of the command units 17 and 18 and the main processing unit 19 may be comprised of a logic circuit such as a digital IC or a small capacity microcomputer.

What is claimed is:

1. A production quantity adjusting apparatus for corrugators comprising:

at least one set of a light emitter and a light receiver disposed to cross at right angles a conveyor which is disposed on a bridge to retain and feed a single-faced corrugated board so as to detect each of the tops of corrugations in said single-faced corrugated board;

a main processing unit supplied with a specified number of cut pieces Cr, a specified cut length Lr, a preset residual quantity Lrst representing a quantity of said single-faced corrugated board residual between a mill roll and said set of light emitter and receiver, a distance L'rst between said set of light emitter and receiver and a rotary cutter, a count value Ca of pieces cut by said rotary cutter and a count value Cano of rejected pieces to compute the following $$Cr \times Lr = Ll \text{ (lot length)} \quad (1)$$

said main processing unit being adapted to make computations according to the following equations each time an output of said set of light emitter and receiver is applied thereto $$(Ca - Cano) \times Lr = Lla \text{ (finished extent)} \quad (2)$$

$$Le - Lla - Lrst - L'rst = Lrl \text{ (first residual lot length} \quad (3);$$

a pulse generator disposed near said mill roll for feeding the liner of said single-faced corrugated board to count the amount of said liner fed; and a single-facer command unit for receiving said lot length Ll and said first residual lot length Lrl computed by said main processing unit to count down a newly received value of said Lrl in response to an output of said pulse generator and thereby to control the amount of said liner fed.

2. An apparatus according to claim 1, wherein said main processing unit computes a second residual lot length L'rl from the following equation, in which L'rst represents the distance between another mill roll for feeding another liner for double-faced corrugated board and said rotary cutter.

$$Ll - Lla - L'rst = L'rl$$

and wherein there are further provided another pulse generator disposed near said another mill roll for feeding said another liner for double-faced corrugated board so as to count the amount of said another liner fed, and a double facer command unit for receiving said lot length Ll and said second residual lot length L'rl to count down a newly received value of said L'rl in response to an output of said another pulse generator and thereby to control the amount of said another liner fed.

3. In a corrugator for the production of finished pieces of cut corrugated board from continuous strips of paper stock wherein paper stock is fed from mill rolls(1,3) at one end of a corrugator, and wherein one strip is fed from a first mill roll(3) and corrugated, and a flat strip or liner is fed from a second mill roll(1) and laminated to said corrugated strip to produce single-faced corrugated board(6), and the single-faced corrugated board is fed to one end of a bridge(7) and withdrawn to a cutter(12) at the other end of said bridge, the combination comprising at least one set of a light emitter and a light receiver(15) disposed along said bridge(7) at a point remote from said mill rolls(1,3) and intermediate the ends of said bridge(7); a first signal generator(20) for generating signals in response to the number of pieces of corrugated board cut by said cutter(12); means(19) responsive to signals from said first signal generator(20) for subtracting the linear amount of liner supplied from said second mill roll(1) from a predetermined set minimum amount theoretically required for a given batch of pieces of cut paperboard and for subtracting in response to signals from said light emitter and light receiver(15) the amount of single-faced corrugated paperboard still on the bridge(7); and means(17) for indicating the residual amount of paper from said second mill roll(1) required for completion of said batch and for discontinuing the feeding of said strips of paperstock from said mill rolls to said conveyor(7) when said residual value is equal to zero.

4. A device according to claim 3 wherein said combination comprises means (21,19) for subtracting from said signals from said first signal generator(20) a number corresponding to the number of cut pieces which are not acceptable in the finished batch.

5. In a corrugator wherein single face paperboard from a single facer machine is fed to a bridge where said single face paperboard is folded to form loops and is withdrawn from the bridge to a cutter which cuts the corrugated board into pieces of specified length, which comprising means for determining the quantity of single face paperboard fed to said bridge and for generating a signal indicative thereof, a quantity control means for presetting the amount of single face paperboard required to produce a given size lot of finished cut pieces, and means for continuously indicating the quantity of single face paperboard required to complete said given size lot, the improvement which comprises at least one set of a light emitter and a light receiver disposed on said bridge at a point remote from said single facer and at a level above said bridge such that the tops of the loops of single face paperboard on said bridge are detected loops generating a signal indicative thereof, counter means for determining the number of finished pieces produced by said cutter and generating a signal indicative thereof, and means responsive to said signals for revising said indication of the amount of single face paperboard required to complete said given size lot in response to signals generated by said set of light emitter and light receiver and to said signals generated by said counter means.

6. An apparatus according to claim 5 wherein single face paperboard withdrawn from said bridge is fed through to a double facer machine producing double face paperboard prior to cutting said paperboard into said cut pieces, and including means for determining the amount of liner fed to said double facer machine and generating a signal indicative thereof, and means for indicating the residual amount of liner needed by said double facer machine to complete said lot in response to signals from said last mentioned signal generator and to signals from said cutter to indicate the amount of said double facer liner required to complete said lot.

7. An apparatus according to claim 6 wherein there is also provided an accept-reject discrimination mechanism for determining the number of rejected cut pieces, said mechanism including means for generating a signal indicative of said number of rejected pieces and wherein said means for determining the residual amounts of said single face paperboard and said double facer liner is automatically adjusted to take into account the additional amounts of paperboard required to complete said lot.

8. A method for producing corrugated paperboard wherein single face paperboard is fed from a single facer machine to a bridge where it is temporarily stored in loops and withdrawn from the bridge to a double facer machine and to a cutter which produces cut pieces of double face corrugated paperboard which comprises the steps of generating a first signal indicative of the quantity of single facer liner supplied to said single facer machine, generating a second signal indicative of the relative position of the tops of the loops of single face paperboard on the bridge, generating a third signal by an accept-reject discrimination mechanism for determining the number of unacceptable finished pieces cut by said cutter, predetermining and presetting the quantity of said single facer liner reqired for a given lot size of cut pieces, automatically subtracting from said preset quantity the quantity of single facer liner supplied to said single facer machine in response to said first signal to determine a residual lot length of liner needed to complete said lot, automatically adding to said residual lot length the amount of single faced liner consumed in producing said rejected pieces in response to said third signal, and automatically adding to said residual lot length the quantity of material lost from the bridge in response to said second signal to indicate the amount of said liner required to complete said lot.

9. A method for producing corrugated paperboard as defined in claim 8 wherein the quantity of liner required for double facing said paperboard is predetermined and preset as a lot length, including the additional steps of generating a fourth signal indicative of the quantity of liner supplied to said double facer machine and automatically subtracting from said preset lot length the amount of liner fed to said double facer machine in response to said fourth signal to indicate a second residual lot length of double facer liner required to complete said lot, and automatically adding to said residual lot length the amounts of liner consumed in producing said rejected pieces in response to said third signal.

* * * * *